United States Patent [19]

McDonough et al.

[11] Patent Number: 4,850,101

[45] Date of Patent: Jul. 25, 1989

[54] DUAL-STATION FLEXIBLE HAIRPIN TUBE EXPANSION APPARATUS

[75] Inventors: Michael L. McDonough, Jamesville; Bruce J. Poplawski, Mattydale, both of N.Y.

[73] Assignee: Carrier Corporation, Syracuse, N.Y.

[21] Appl. No.: 202,933

[22] Filed: Jun. 6, 1988

[51] Int. Cl.[4] ..... B23P 15/26

[52] U.S. Cl. ..... 29/727; 29/157.3 C; 29/430; 29/523; 29/796

[58] Field of Search ..... 29/157.3 C, 157.3 R, 29/430, 469.5, 523, 33 G, 33 P, 33 T, 565, 727, 796, 824; 414/746

[56] References Cited

U.S. PATENT DOCUMENTS

| | | | |
|---|---|---|---|
| 3,688,533 | 9/1972 | Ames | 29/727 |
| 3,733,673 | 5/1973 | Young et al. | 29/727 |
| 4,581,912 | 4/1986 | Initani et al. | 29/796 |
| 4,631,813 | 12/1986 | Daniels et al. | 29/727 |
| 4,738,014 | 4/1988 | Gray | 29/727 |

FOREIGN PATENT DOCUMENTS

| | | | |
|---|---|---|---|
| 0068237 | 4/1982 | Japan | 29/33 G |
| 0785012 | 12/1980 | U.S.S.R. | 29/33 G |

*Primary Examiner*—Howard N. Goldberg
*Assistant Examiner*—Irene Cuda
*Attorney, Agent, or Firm*—Bernhard P. Molldrem, Jr.

[57] ABSTRACT

A flexibly programmable belling and tension expanding device for plate fin heat exchanger coils is carried on a shuttle or carriage that moves between first and second work stations. An operator assembles a fin plate heat exchanger unit at a work table at one work station while the device automatically bells and expands the hairpin tubes of another unit at a second station. When assembly is complete, the operator signals a programmable controller, and the shuttle brings the device to the one coil after it completes the expanding of the other, and it commences an automatic expanding operation. Then the operator removes the expanded coil and assembles another coil at the second station while the device is belling and coiling at the one station.

7 Claims, 3 Drawing Sheets

DUAL-STATION FLEXIBLE HAIRPIN TUBE EXPANSION APPARATUS

BACKGROUND OF THE INVENTION

This invention relates to the manufacture of plate-fin heat exchangers, and is more particularly directed to apparatus for belling and expanding hairpin tubes into a fin pack.

Plate-fin type heat exchangers are often employed in air conditioning systems and refrigeration systems. These plate-fin units are typically formed by lacing hairpin tubes or U-tubes into aligned holes in a stack of fin plates and tube sheets, with the U-bend sections extending out one of the tube sheets and the open ends of the hairpin tubes protruding out the other tube sheet. The walls of the tubes, which are typically copper, are then expanded radially into contact with the metal of the fin collars and the tube sheets, which establishes both good thermal contact and firm mechanical support. The hairpin tube open ends are belled, either before or after tube expansion, and return bends are soldered or brazed into the belled ends to close the flow circuit of the unit.

While the hairpin tubes can be supported from the U-bend side during expansion, i.e., a process known as compression expansion, such a technique is not preferred because of a tendency to bend the tubes, and also because of an uncertainty in establishing an offset distance between the open ends of the tubes and the tube sheet. A compression expansion technique is described in U.S. Pat. No. 4,228,573.

A tension-expansion technique involves belling the hairpin tubes prior to expansion and then supporting the tubes by their belled ends while expander rods are driven into the two legs of each hairpin tube. The tubes can be belled directly against the associated tube sheet so that the tube sheet supports the hairpin tubes during expansion, or else the bells can be formed at an established standoff distance above the tube sheet. In the latter case the belled ends can be supported in a clamping jaw or similar device during expansion. One technique for belling and expanding hairpin tubes in a heat exchanger is described in U.S. Pat. No. 4,584,765.

To date, there has been no equipment or apparatus proposed which permits tension expansion of the hairpin tubes of a plate-fin heat exchanger and in which belling and expanding are carried out at a single station. There has also not been proposed a hairpin tube expander which permits the belled ends of the hairpin tubes to be offset a finite distance from the associated tube sheet. No apparatus has been proposed that permits belling and expanding of hairpin tubes where a tube sheet flange extends over the open ends of the hairpin tubes.

Generally, apparatus for belling and/or expanding a plate-fin heat exchanger coil is in use only a small fraction of the time and waits idle for a large fraction of the time. That is, compared with the time required for expanding the heat exchanger tubes, considerably more time is required to build up or set up the tube sheets, fin plates and hairpin tubes, and to transport the expanded coil after an expansion operation. No attempt has been made to reduce or eliminate the cueuing of the belling and expanding device, or to time-share an expander device between two or more stations.

OBJECTS AND SUMMARY OF THE INVENTION

Accordingly, it is an object of this invention to expand tubes in a plate-fin heat exchanger coil while avoiding the drawbacks of the prior art.

It is another object of this invention to provide a technique for improving the efficiency of belling and expanding hairpin heat exchanger tubes.

It is a further object of this invention to provide belling and expanding apparatus which can be controlled by a suitable stored program to expand the hairpin tubes of a plate-fin coil unit.

It is a still further object of this invention to provide apparatus for tension expansion of heat exchanger tubes and which operates on two (or more) work stations, so as to minimize or eliminate idle time for the apparatus.

According to one aspect of this invention, belling and expanding apparatus are provided for tension expansion of a heat exchanger coil.

A dual-station flexibly-programmable tube expansion cell has first and second work stations, at least, with respective first and second work tables or coil assembly tables disposed at them. Each table includes a clamp for clamping a heat exchanger coil so that a front tube sheet is positioned at an established, predetermined position at its work station. There are a number of hairpin heat exchanger tubes laced through a back tube sheet, a stack of fin plates, and a front tube sheet so that their open ends protrude from the front tube sheet. A flexibly programmable tension expansion device bells the open ends of the heat exchanger tubes, and then, while supporting the tubes by the belled ends, expands them under tension by driving expander rods through the legs of the hairpin tubes. In a preferred arrangement, an impact belling device bells the tube ends progressively, moving row-wise across the coil, followed by the expander rods and their associated grippers. When a row or pair of adjacent rows has been belled and expanded, the expansion device is indexed to another row of tubes and the process is repeated until the belling and expansion is completed.

While the expansion device is operating on the heat exchanger coil at one station, a previously expanded coil is removed from the table at the second station, and a new heat exchanger coil is set up on that table for belling and expanding its tubes. When the operator has completed set-up of the new coil at the second table, he or she actuates a control switch or button. Then, as soon as the expander device has completed its function at the one station, the expander device cycles to the second station and commences automatic belling and expansion of the coil at that station while the operator removes the expanded heat exchanger coil at the one station and sets up another heat exchanger coil at that work table. In one embodiment the expander device cycles by shuttling on a rail between two fixed stations, although in other embodiments the location of the expander device can be fixed and the work tables can cycle, e.g., between a set up position and an expansion position.

Preferably, the expanding device steps in the row-wise direction one tube end at a time over the length of the tube sheet, and then can step or index to the next row (by raising the coil or lowering the expanding device), and traverse that row. The device works within the constraints of an evaporator or condenser coil, which can have a wide flange on either side of each tube sheet.

The above and many other objects, features, and advantages of this invention will become more apparent from the ensuing detailed description of a preferred embodiment, when considered in connection with the accompanying Drawing.

DETAILED DESCRIPTION OF A PREFERRED EMBODIMENTS

Figure 1:
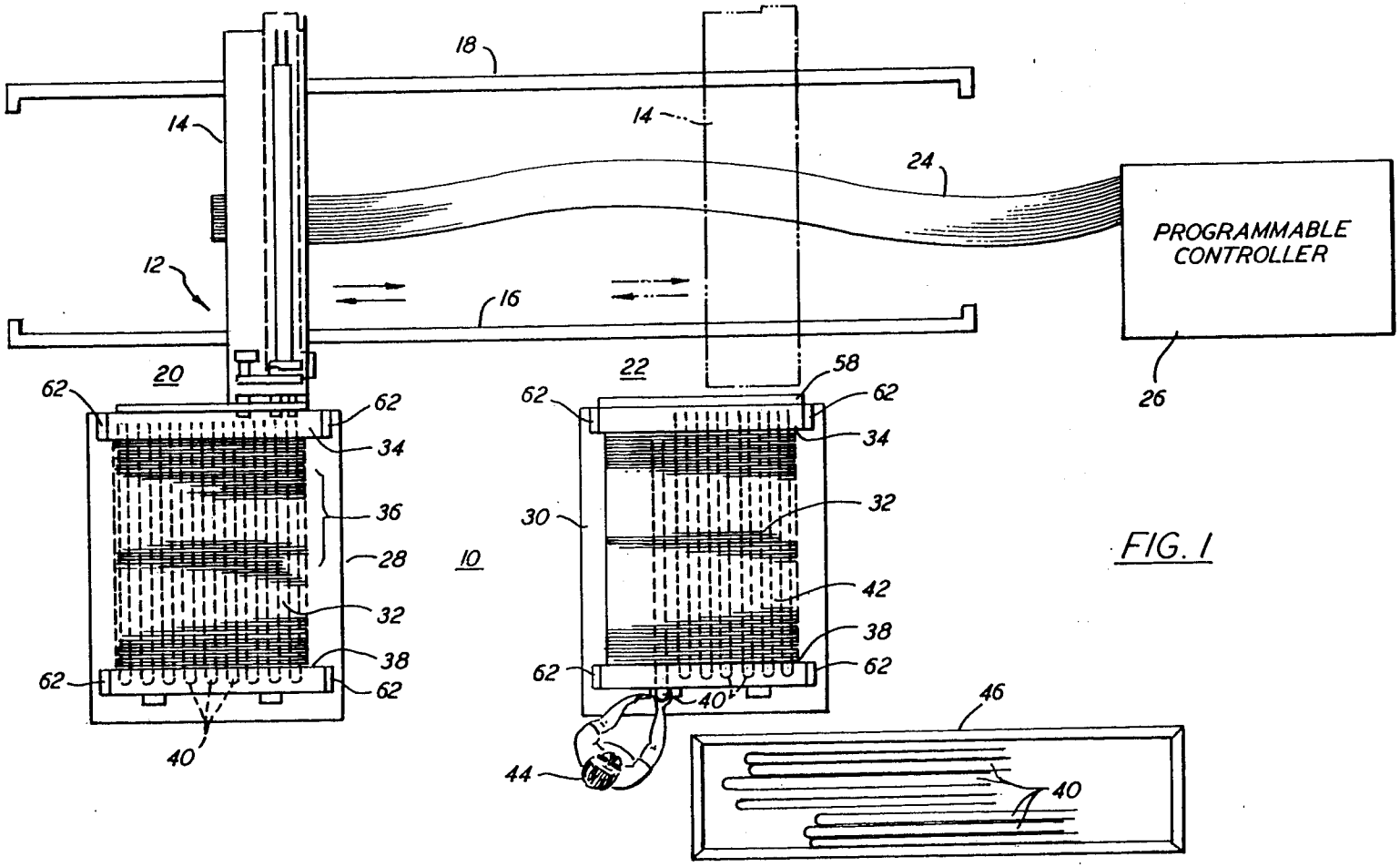
FIG. 1 is a plan view of a heat exchanger tube expansion cell according to one preferred embodiment of this invention.
Figure 2:
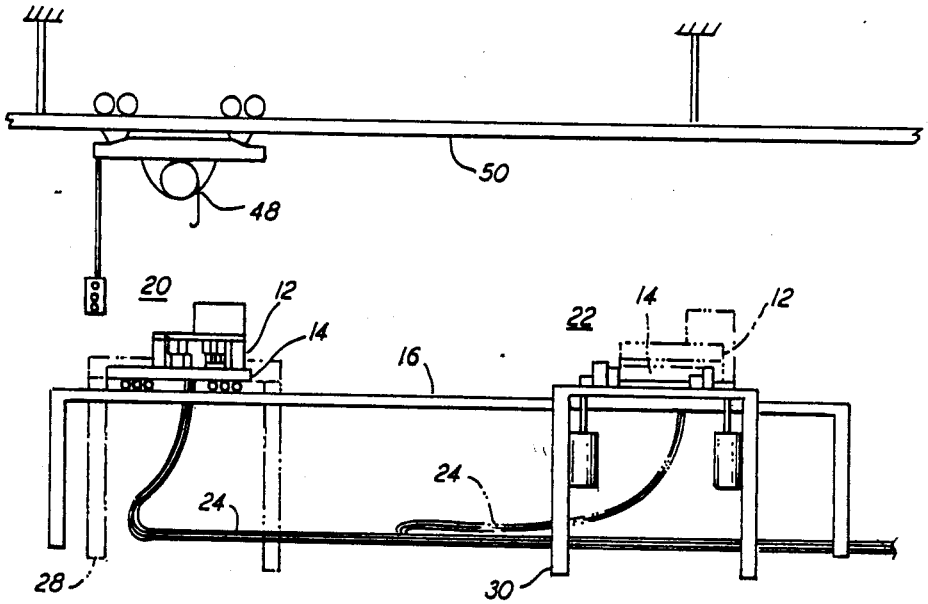
FIG. 2 is a front elevation of the expansion cell of said preferred embodiment.

With reference to the Drawing, FIGS. 1 and 2 show a flexibly programmable belling and expanding work cell 10 which embodies the concepts of the present invention. At the heart of this work cell 10 is a flexibly programmable combination belling and expanding device 12 which can be, for example, of the type described in commonly-assigned copending patent application Ser. No. 07/202892 for Single Station Tension Tube Expander. The disclosure of that patent application is incorporated herein by reference. The belling and expanding device is carried on a shuttle 14 or carriage mounted on front and rear rails 16,18 and is shuttled between first and second work stations 20 and 22. A third rail (not shown here) can be positioned between the rails 16 and 18. The position of the second work station 22 is indicated in ghost lines in FIGS. 1 and 2. A flexible umbilical 24 contains power, signal, and hydraulic connection between the device 12 and a programmable controller 26. The latter is a computer-based mechanism which controls the operation of the belling and expanding device in accordance with a stored program that relates e.g. to the hairpin configuration of the partially-assembled heat exchanger coil workpieces.

The two work stations 20 and 22 are spaced apart from one another, and at each there is located a respective first and second assembly work table 28 and 30. A first partially completed heat exchanger coil 32 is situated at the work table 28 and comprises a front tube sheet 34 on the side facing the device 14, a stack of fin plates 36, and a rear tube sheet 38, all clamped in place on the table 28. A number of hairpin heat exchanger tubes 40 are laced into aligned holes in the fin plates and tube sheets so that the open ends thereof protrude out from the front tube sheet 34.

A second heat exchanger coil 42 is formed of similar tube sheets 34,38 and fin plates 36, and is clamped on the second table 30. An operator 44 is shown in the process of inserting or lacing the hairpin tubes 40 into the coil 42, and a supply bin 46 containing a sufficient number of these hairpin tubes is kept at hand. While this embodiment involves a human operator in the assembly of the heat exchanger coils 32, 42, the possibility of automated assembly is contemplated, as is the possibility of positioning previously assembled coils on the tables 28 and 30.

As shown in FIG. 2, an overhead crane 48 is provided here, which traverses above the tables 28,30 on an overhead railway 50. This crane is employed by the operator 44 in removing the expanded coils 32,42 from the respective work stations after completion of a belling and expanding operation.

Figure 3:
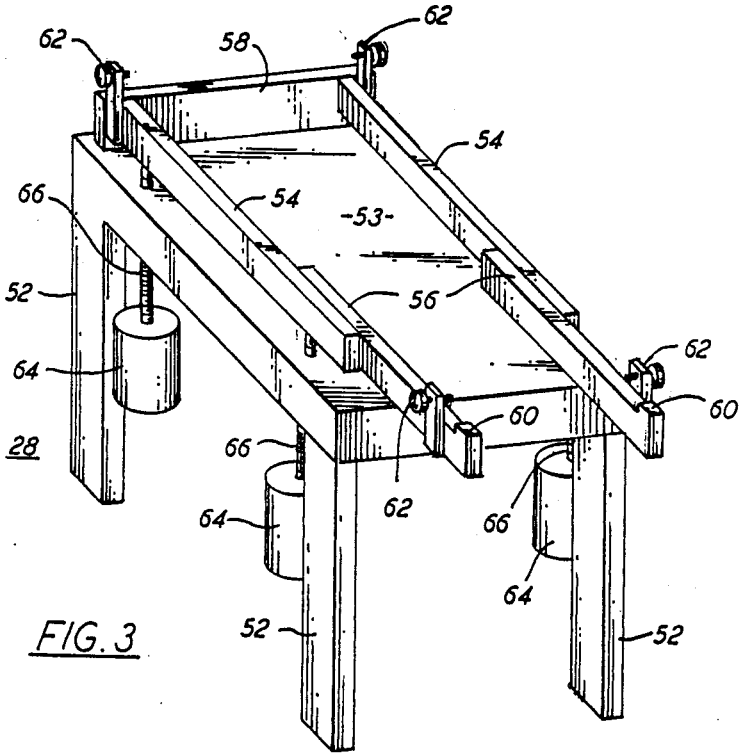
FIG. 3 is a perspective view of an assembly work table of this embodiment.

The two assembly tables 28 and 30 can be of substantially identical construction; the table 28 is illustrated in detail in FIG. 3. The table has legs 52 at its corners and a top 53 on which are situated a pair of parallel support members 54. There are also a pair of extension members 56 that lie parallel to one another and slide out to accommodate heat exchanger coils of various lengths. A removable front brace 58 provides a means for establishing the position of the open ends of hairpin tubes 40. At this end of the table there are also support members 54 and 56. The front tube sheet 34 is clamped to support members 54 by front clamps 62 and the rear tube sheet 38 is clamped to support members 56 by rear clamps 62. Clamping actuators, for the clamps 54 and 56 permit the operator to clamp the heat exchanger coil 32 or 42 in place for a belling and expanding operation, and to unclamp same for removal when the operation is complete.

As shown in this embodiment, affixed to the table legs 52 are stepper devices 64, which can be electric or hydraulic motors. These have lift rods 66 which protrude upwards and connect with the support members 54. By this means, the heat exchanger coils can be indexed by the height of one row of tube ends each time the belling and expansion device 12 has traversed the tube sheet 34.

Figure 4:
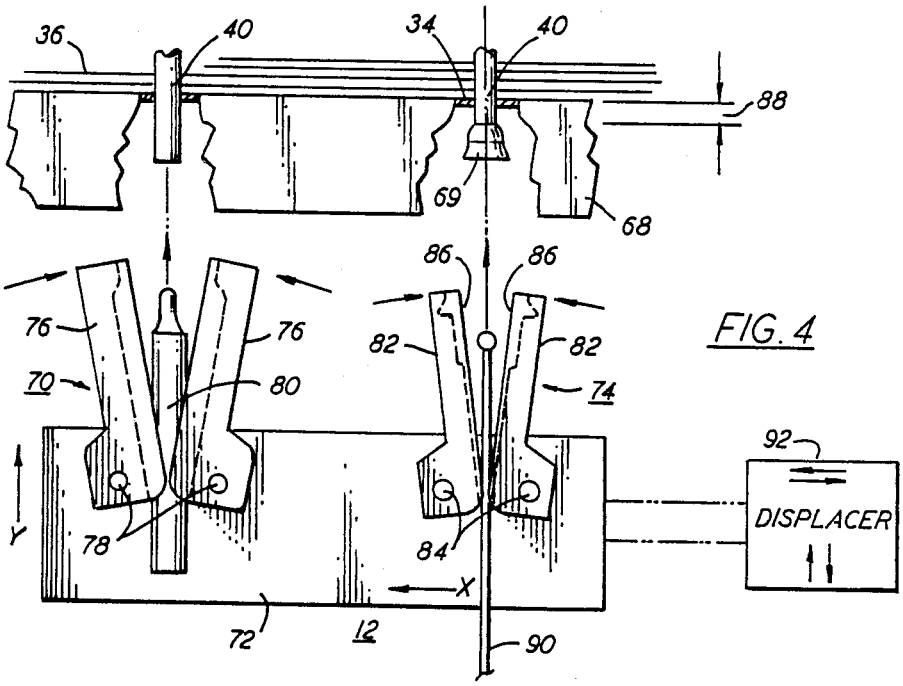
FIG. 4 is a schematic top plan view of a belling and expanding device employed in this embodiment.
Figure 5:
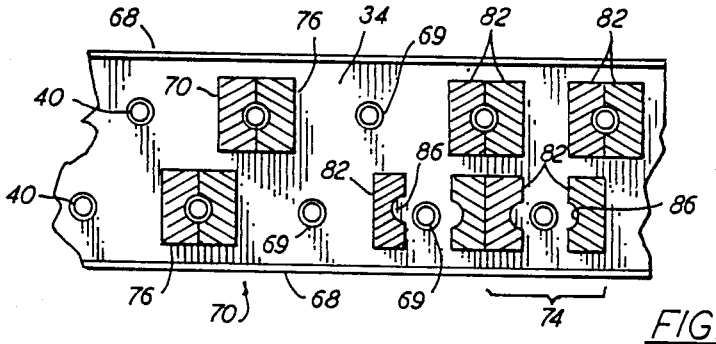
FIG. 5 is a schematic front elevation showing action of the gripping jaw fingers.
Figure 6:
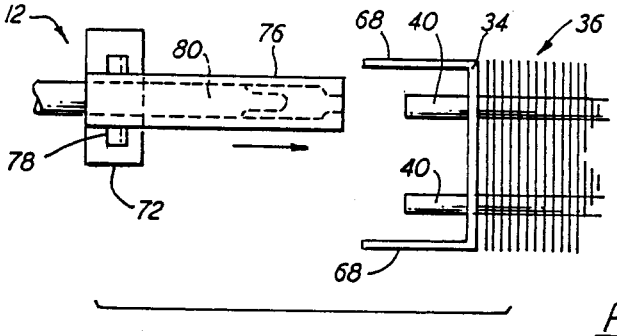
FIG. 6 is a schematic side elevation of the belling and expanding device.

In FIGS. 4, 5, and 6, the tube belling and expanding device 12 is shown in greater detail. Here, the front tube sheet 34 has a pair of flanges 68 which extend out beyond the open ends of the hairpin tubes 40. The apparatus is arranged to form flared bells 69 on two hairpin tube ends at a time, and to expand two-of-four, or four-of-four adjacent tube legs, i.e., to expand one hairpin tube or two hairpin tubes 40 at a time.

In the heat exchanger coil, the tube sheet flanges 68 face forwards, requiring an impact beller of a special design. In this situation, it is not possible to employ the beller of U.S. Pat. No. 4,584,765. The flared bell 69 stands off from the tube sheet 34, and thus must be held by a gripper and not simply be supported only by the tube sheet during expansion. It is also desired to bell and expand the hairpin tubes 40 at a single station because of space limitations and to minimize the handling and transfer of the heat exchanger units.

The apparatus includes bellers 70,70, positioned over-and-under, which are mounted on a frame or carriage 72 to traverse the tube sheet 34 and bell two tube ends at a time. A four-tube expander 74 is also mounted on the carriage 72 to follow the bellers 70 and expand the appropriate tube legs that correspond to a single hairpin 40.

The bellers 70 each comprise a pair of gripper fingers 76 that swing together on pivot pins 78. The fingers 76 reach under the tube sheet flanges 68 and open in a sideways direction (FIG. 4). As only two tubes are belled at any one time, and these in different rows, there is ample side clearance for finger opening. These beller jaw fingers 76 must be clamped with considerable force to clamp the smooth tube, and thus are made rather thick to prevent flexing due to their length. The mating faces of the fingers 76 are provided with a profile surface against which the metal of the tube ends is expanded to form the end bells 69.

The beller jaw fingers 76 grip the tube ends while a belling punch or tool 80 advances between the fingers to form the bell 69. Here, the belling tool can be a two-stage device comprising a pinching bullet which enters the tube end to expand it outward sufficiently to receive the return bend, and a flaring collar that enters the end to form a bell flare. This type of impact belling tool is described in greater detail in commonly-assigned application Ser. No. 202,894, filed June 6, 1988. After the bells 69 have been formed, the belling tool 80 is withdrawn and the fingers 76 are opened.

At the same time that a belling operation is taking place, the four-tube expander 74 carries on a tension-expansion operation. The expander 74 comprises two pairs of opposed expander jaw fingers 82 in each of two rows. These fingers 82 are mounted by pivot pins 84 onto the carriage 72 and each pair has a profiled cavity 86 formed on opposed mating faces. The bell 69 is held off from the tube sheet 34 a predetermined standoff distance 88, and an expander rod 90 associated with each pair of expander jaw fingers 82 enters the belled tube end between the fingers 82. Here the expander jaw fingers 82 are thin-walled to obtain sufficient side-to-side clearance. The required clamping force for these fingers 82 is comparatively low, as the reaction to the expansion force applied to the tube bell is primarily axial and the fingers 82 grip the flared portion of the bell 69. These beller fingers 82 reach under the tube sheet flanges 68 and open in a sideways direction. Hairpin tubes 40 are expanded by selecting and advancing two (or four) of the four expander rods 90 according to hairpin orientation. The rods 90 pass through the length of the legs of each hairpin tube to drive the same out into thermal and mechanical contact with the fin collars and tube sheets. Thereafter, the rods 90 are withdrawn back out through the fingers 82, and the latter are opened. A displacer mechanism 92 (shown here schematically) pulls carriage 72 back slightly and then steps or indexes it sideways to the position of the next tube ends. Thereafter the carriage advances towards the heat exchanger unit and the beller and expander jaw fingers 76 and 82 reach under the tube sheet flange 68 to grasp the next unbelled and belled tube ends, respectively. The belling and expanding operation is repeated across an entire row. When the apparatus has proceeded across each row, the stepper devices 64 lift the heat exchanger unit to present the next adjacent row.

If it is desired to place the bells 69 directly on the tube sheet 34, i.e., with a standoff distance of zero, the gripper profile surfaces 80 for the belling jaw fingers 76 could be designed accordingly. Then, if it is desired to support the tubes directly by the front tube sheet during expansion, the fingers 82 could be omitted, or could simply be disabled during expansion.

The expander jaw fingers 82 are shown in FIG. 5, as two pairs superposed above another two pairs, with the upper two pairs of fingers 82 closed, the lower two pairs open, but only for purposes of illustration. In a practical embodiment, all the gripper fingers 82 open and close together, as do the beller jaw fingers 76.

With the heat exchanger coil work cell 10 as described hereinabove, the coil 32 or 42 is assembled at one work station 20 or 22 and then is expanded at the same work station. This eliminates the step of transporting a heat exchanger coil to an expander machine, as required in a typical currently-employed procedure.

Here both the operator 44 and the belling and expanding device 12 are employed optimally.

While the previously assembled and laced coil 32 is belled and expanded at the first work station 20, the operator 44 is assembling the heat exchanger coil 42 at the other work station 22. After the operator is finished, he or she actuates a control or switch and when the device 12 is finished with the coil 32 at the first work station, the controller 26 causes the shuttle 14 to bring the belling and expanding device 12 to the second work station 22 where it automatically traverses that coil, row by row, to bell and expand the hairpin tubes 40. While that is taking place, the operator 44 removes the completed coil 32 from the table 28 at the first work station 20, and assembles the tube sheets 34,38 and plate fins 36 for another unit, and laces the hairpin tubes 40 in a prescribed pattern, located by the removable plate 58. Then, when the operator 44 is completed with this task, he or she again actuates a switch and the shuttle 14 brings the belling and expanding device 12 back to the first work station 20 as soon as the belling and expanding operation is complete on the second coil 42. This process is repeated continuously. The waiting time or idle time for the belling and expanding device 14 is kept to a minimum, i.e., to the time required to shuttle between the two work stations 20 and 22.

In this embodiment, the operator attaches a bar code label to the front tube sheet 34 when he or she is finished lacing the hairpin tubes 40. An optional bar code scanner 94 mounted on the shuttle 14 (See FIG. 1) picks up the code from the bar code label, and furnishes the information therefrom to the controller 26. This permits the operator to reconfigure the belling and expanding program simply by applying a different label, and thus permits the expansion of mixed types of heat exchanger coils at the same cell 10 at the same time.

Also, while the expanding device 12 is shown here shuttling between positions, it is also possible that the work tables 28,30 could shuttle from an assembly position to an expanding position, with the device 14 being at a fixed position. Also, three or more work stations could be involved.

The same general expanding cell 10 can be employed for expanding coils that have been pre-assembled at a remote location. In that case the tables 28,30 can be configured as clamping fixtures to establish a preset distance between the front tube sheets and the belling and expanding device 12. The cell 10 could likewise be employed for belling and expanding "composite coils", i.e., coils that are comprised of individual parallel slabs which share a common front or bell-end tube sheet. In this configuration, the slabs can be assembled and laced at remote assembly stations and transferred to the work station where they are fitted to the common tube sheet, located at the proper position, and clamped in place. When these activities are complete, the controller 26 is signalled that the coil is ready, and the belling/expanding operation is automatically carried out.

This invention, or course, comprehends expanding operations on heat exchanger coils that comprise straight tubes, either in addition to the hairpin tubes or completely replacing them.

While one specific embodiment has been illustrated to serve as an example, it should be apparent that many other configurations of this device could be constructed according to the principles of this invention. For example, the belling and expansion could take place along a single row of tubes, or could take place along three or more rows simultaneously. Also, the belling and expander gripper fingers can be replaced with other suitable gripper fingers so as to accommodate hairpin tubes of different diameters, or of different materials.

The apparatus of this invention can be programmed in advance and can be computer controlled to identify the tube ends corresponding to each hairpin tube so as to actuate the correct expander rods at the appropriate times.

The present invention has been described with respect to a preferred embodiment, but it should be recognized that the invention is not limited to that precise embodiment. Rather, many modifications and variations would present themselves to those of skill in the art without departing from the scope and spirit of this invention, as defined in the appended claims.

What is claimed is:

1. Dual station flexible tube-expansion apparatus comprising a frame having a transverse rail; a shuttle carried on said rail including means for moving the shuttle between first and second work stations adjacent said rail; first and second work tables adjacent said rail at said first and second work stations, each including means for clamping a plate fin heat exchanger that is formed of front and back tube sheets with a plurality of fin plates stacked therebetween and a plurality of heat exchanger tubes laced into the stacked fin plates and tube sheets such that open ends of the tubes protrude out of the front tube sheet towards said rail; the clamping means disposing said front tube sheet at a predetermined position facing said rail; a flexibly-programmable tension expanding device carried on said shuttle including belling means for belling the open ends of said heat exchanger tubes at each of said first and second work tables in turn and means for expanding said heat exchanger tubes including gripping means for gripping bell ends of said tubes previously belled by said belling means and expander means for expanding said tubes being gripped including one or more expander rods and means for driving said one or more rods through said tubes; and programmable control means for moving said shuttle between said first and second work stations alternately and commencing automatic operation of said belling means and said expanding means on the heat exchanger at each of the first and second work tables when the belling and expanding of the heat exchanger at the other of the work tables has been completed.

2. Dual station flexible tube expansion apparatus comprising first and second work stations with first and second work tables being disposed at said first and second work stations, respectively, each including means for clamping a plate fin heat exchanger that is formed of front and back tube sheets with a plurality of fin plates stacked therebetween and a plurality of heat exchanger tubes laced into the stacked fin plates and tube sheets such that open ends of the tubes protrude out of the front tube sheet; a flexibly programmable tension expanding device including belling means for belling the open ends of said heat exchanger tubes at each of said first and second work tables in turn and means for expanding said heat exchanger tubes including gripping means for gripping belled ends of said tubes previously belled by said belling means and expander means for expanding said tubes being gripped including one or more expander rods and means for urging said one or more expander rods through said tubes; means for moving said work stations and said flexibly programmable tension expanding device relative to one another so that the expanding device is alternately positioned facing the heat exchanger units on said first and second work tables with the clamping means on said tables disposing the associated front tube sheets at a predetermined position relative to the expanding device; and programmable control means for controlling movement of said work tables relative to said expanding device so that when the belling and expanding of the heat exchanger at one of the first and second work tables has been completed, the control means causes the moving means to alternate the positions of the first and second work stations relative to said expanding device so that the other of the work tables and the expanding device are positioned adjacent one another, and said control means commences automatic operation of said belling means and said expanding means on the heat exchanger at the other of said work tables.

3. Dual station flexible tube-expansion apparatus according to claim 2 wherein said clamping means at said work tables include means for clamping said front tube sheet and said back tube sheet with said fin plates having fin apertures in registry to permit insertion of hairpin tubes in the heat exchanger at one of the tables while the expanding device is belling and expanding the tubes in the heat exchanger at the other of the work tables.

4. Dual station flexible tube-expansion apparatus according to claim 2 wherein said work tables each include means for stepwise elevating the heat exchanger carried thereon relative to the flexibly programmable tension expanding device so that the latter can bell and expand the heat exchanger tubes row by row.

5. Dual station flexible tube-expansion apparatus according to claim 11 wherein the belling means of said flexibly programmable tension expanding device includes a pair of clamping jaws which grip an unbelled one of the tube ends and a belling die which enters the tube end being gripped by said clamping jaws to enlarge the inner diameter at said tube end and to form a flare at a proximal tip thereof; and in the expander means the gripping means includes a gripping device for gripping the flared tips of a pair of said heat exchanger tube ends previously belled by said belling means, and said expander means include a corresponding pair of expander rods.

6. Dual station flexible tube-expansion apparatus according to claim 5 wherein said gripping device comprises two pairs of gripping fingers for gripping two adjacent belled tube ends in one row of said heat exchanger tube ends that protrude from the front tube sheet.

7. Dual station flexible tube-expansion apparatus according to claim 6 in which said flexibly programmable tension expanding device includes means for indexing said belling means and said expanding means progressively from one tube to the next adjacent tube across each row thereof.

* * * * *